US010172449B2

(12) United States Patent
Luciew et al.

(10) Patent No.: US 10,172,449 B2
(45) Date of Patent: Jan. 8, 2019

(54) MOVABLE COMPUTER WRIST SUPPORT WITH MAGNETIC LEVITATION

(71) Applicants: Michele Lynn Luciew, Johnstown, PA (US); James David Luciew, Johnstown, PA (US)

(72) Inventors: Michele Lynn Luciew, Johnstown, PA (US); James David Luciew, Johnstown, PA (US)

( * ) Notice: Subject to any disclaimer, the term of this patent is extended or adjusted under 35 U.S.C. 154(b) by 0 days.

(21) Appl. No.: 15/601,409

(22) Filed: May 22, 2017

(65) Prior Publication Data

US 2017/0295922 A1 Oct. 19, 2017

Related U.S. Application Data

(63) Continuation-in-part of application No. 15/095,359, filed on Apr. 11, 2016, now Pat. No. 9,655,440.

(60) Provisional application No. 62/217,164, filed on Sep. 11, 2015, provisional application No. 62/145,819, filed on Apr. 10, 2015.

(51) Int. Cl.
*F16M 11/00* (2006.01)
*A47B 21/03* (2006.01)

(52) U.S. Cl.
CPC ..... *A47B 21/0371* (2013.01)

(58) Field of Classification Search
CPC . G06F 1/16; H04M 1/00; G05G 9/047; B64C 13/04
See application file for complete search history.

(56) References Cited

U.S. PATENT DOCUMENTS

| | | | | |
|---|---|---|---|---|
| 5,193,771 | A | 3/1993 | Hassel et al. | |
| 5,340,067 | A | 8/1994 | Martin et al. | |
| 5,398,896 | A | 3/1995 | Terbrack | |
| 5,439,192 | A | 8/1995 | King | |
| 5,868,365 | A | 2/1999 | Hesley | |
| 5,913,497 | A | 6/1999 | Myers | |
| 9,736,280 | B2 * | 8/2017 | Lawrenson | G06F 1/1666 |
| 9,898,033 | B1 * | 2/2018 | Long | G05G 9/047 |
| 2006/0210340 | A1 | 9/2006 | Atzmon | |
| 2011/0095142 | A1 | 4/2011 | Quiroga et al. | |
| 2011/0226920 | A1 | 9/2011 | Moses | |
| 2011/0290161 | A1 | 12/2011 | Faubion | |
| 2014/0123461 | A1 | 5/2014 | Whitesids et al. | |

FOREIGN PATENT DOCUMENTS

WO 9905062 A1 2/1999

* cited by examiner

*Primary Examiner* — Amy J. Sterling
(74) *Attorney, Agent, or Firm* — The Webb Law Firm

(57) ABSTRACT

Disclosed is a movable wrist support device for elevating and enabling natural motion of the hand/or wrist of an individual when the individual is using a computer input device. The movable wrist support device includes a base member, a wrist support member, and one or more magnets for magnetically levitating the wrist support member a distance above the base member when the wrist support member is positioned above the base member. The movable wrist support device can include magnetically susceptible material that is magnetically attracted to the one or more magnets. Also or alternatively to the magnetically susceptible material, the movable wrist support device can include a slide assembly upon which the wrist support device rests in use of the movable wrist support device.

20 Claims, 7 Drawing Sheets

MOVABLE COMPUTER WRIST SUPPORT WITH MAGNETIC LEVITATION

CROSS REFERENCE TO RELATED APPLICATIONS

This application is a Continuation-in-Part of U.S. patent application Ser. No. 15/095,359, filed Apr. 11, 2016, which claims the benefit of U.S. Provisional Patent Application No. 62/217,164, filed Sep. 11, 2015 and U.S. Provisional Patent Application No. 62/145,819, filed Apr. 10, 2015, the disclosures of all of which are incorporated by reference herein.

BACKGROUND OF THE INVENTION

Field of the Invention

Disclosed herein is a support apparatus for the hand and wrist when an individual is using a computer input device such as a mouse, touchpad, or keyboard. More specifically, the disclosed hand and wrist support apparatus utilizes magnetic levitation as a means to actively float and elevate the hand on a friction-free, magnetic barrier. The device enables natural, unrestricted multidimensional movements, gestures, micro adjustments, and provides cushioning to absorb repetitive strain and relieve pressure on the carpal tunnel region of the wrist anytime the individual is using a computer input device.

Description of Related Art

The advancement of technology, and computer technology in particular, has led to an increase in the number of individuals who remain seated in front of a computer for an extended period of time. For example, fields such as graphic design, engineering, software engineering, three-dimensional design, and modeling require extensive use of input devices over a prolonged period of time.

To operate an input device, an individual manipulates the device, such as a computer mouse, with the individual's hand bent backwards while a portion of the user's wrist or hand rests on a stationary support, such as a desk or other work surface. Injuries including repetitive stress injury and carpal tunnel syndrome often accumulate over time as a result of the user performing small and repetitive movements while the hand and wrist are in this position.

Carpal tunnel syndrome is primarily attributed to the compression of the median nerve within the carpal tunnel area of the wrist. Carpal tunnel syndrome is characterized in the short term by numbness experienced in the thumb and fingers. Long term carpal tunnel syndrome may result in permanent nerve damage, muscular atrophy, and weakened joints.

When the hand is bent back and the wrist remains in contact with the work surface, as is the case when a user is manipulating a computer input device, the carpel tunnel area of the wrist is subjected to significant stress and pressure. Specialized mice, trackpads, and touch screens have been created in an attempt to alleviate this problem. However, these devices restrict movement and for the most part, keep the hand stationary relative to the computer input device. The devices that do allow movement are limited to horizontal motions across the work surface and do very little to enable friction free, multidirectional, based motions commonly and advantageously used by an individual using a computer input device. Moreover, many of these devices are specifically configured for a particular input device, such as a gel support pad for use with a mouse, and are not able to effectively and efficiently function with other input device types. Furthermore, gel support pads and like devices often compress over time.

Therefore, there is a need for an ergonomic wrist support that actively adapts to the natural movements of a user's hand and wrist while providing ergonomic cushioning and support that protects against the repetitive strain injuries and pressure on the carpal tunnel region of the wrist commonly associated with the operation of a computer input device.

SUMMARY OF THE INVENTION

The device disclosed herein overcomes the problems associated with the traditional devices via a magnetic levitation means that actively floats and elevates the user's hand on a friction-free, magnetic barrier that enables unrestricted natural motion, gesture, and micro adjustment while providing cushioning to absorb the repetitive strain to the hand and carpal tunnel region of the wrist anytime the individual is using a computer input device. Further, the magnetic barrier serves to enable vibrational isolation between the base member and the wrist support surface. As such, the device disclosed herein is able to adapt to common movements of the hand and wrist that occur while using an input device such as typing or using a scroll wheel.

Unlike gel support pads and other prior art devices, the magnetic levitation means supports and conforms to the user's hand/wrist without compressing into a hard flat surface over time. Moreover, the wrist support device disclosed herein dynamically supports user motions, adapts to the input device in use, and moves with it by gliding along any work surface.

More specifically, disclosed herein is a movable wrist support device for actively supporting, floating, and elevating the wrist of an individual on a friction-free magnetic barrier that enables natural motion and gestures when the individual is using a computer input device. The movable wrist support device includes a base member, a wrist support surface member, and a magnetic levitation means for levitating the wrist support surface member a distance above the base member when the wrist support surface member is positioned above the base member. The movable wrist support further comprises a connection means for preventing disconnection of the wrist support surface member from the base member and laterally aligning the wrist support surface member with respect to the base member when the wrist support surface member is levitating above the base member.

In an example, the base member comprises a first magnet and the wrist support surface member comprises a second magnet. The first magnet and the second magnetic are magnetically opposed to one another when the wrist support surface member is positioned above the base member.

The bottom member can include a flat central portion arcing upwardly from the flat central portion towards a perimeter of the bottom surface of the base member. The wrist support surface member can be saddle shaped.

BRIEF DESCRIPTION OF THE DRAWINGS

Examples will now be described in further detail with reference to the accompanying figures, in which.

DESCRIPTION OF THE INVENTION

Figure 1:
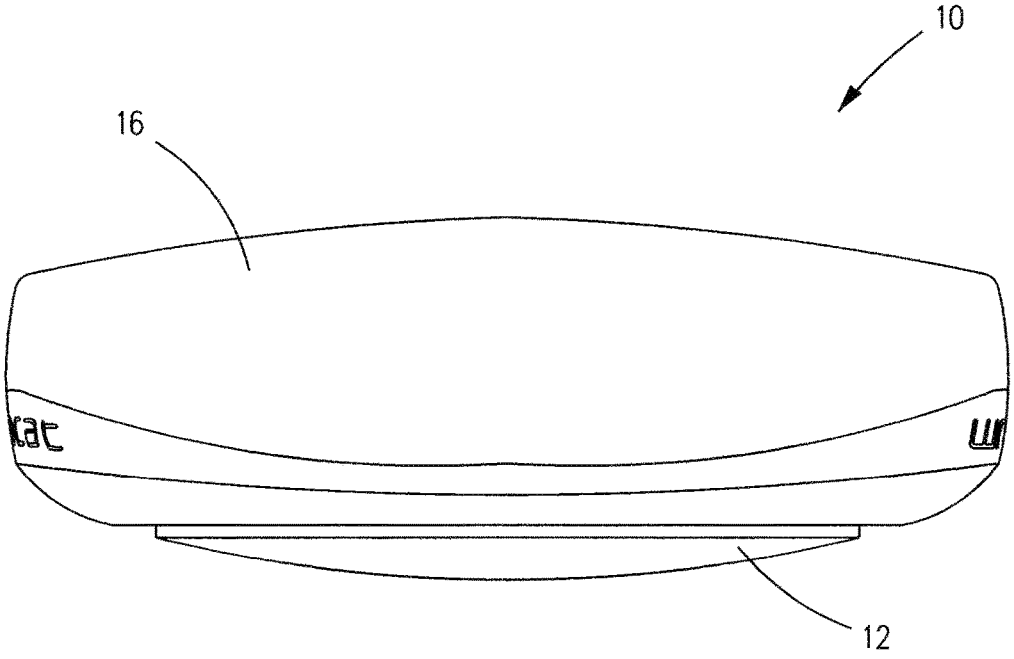
FIG. 1 is a side view of an example wrist support device.
Figure 2:
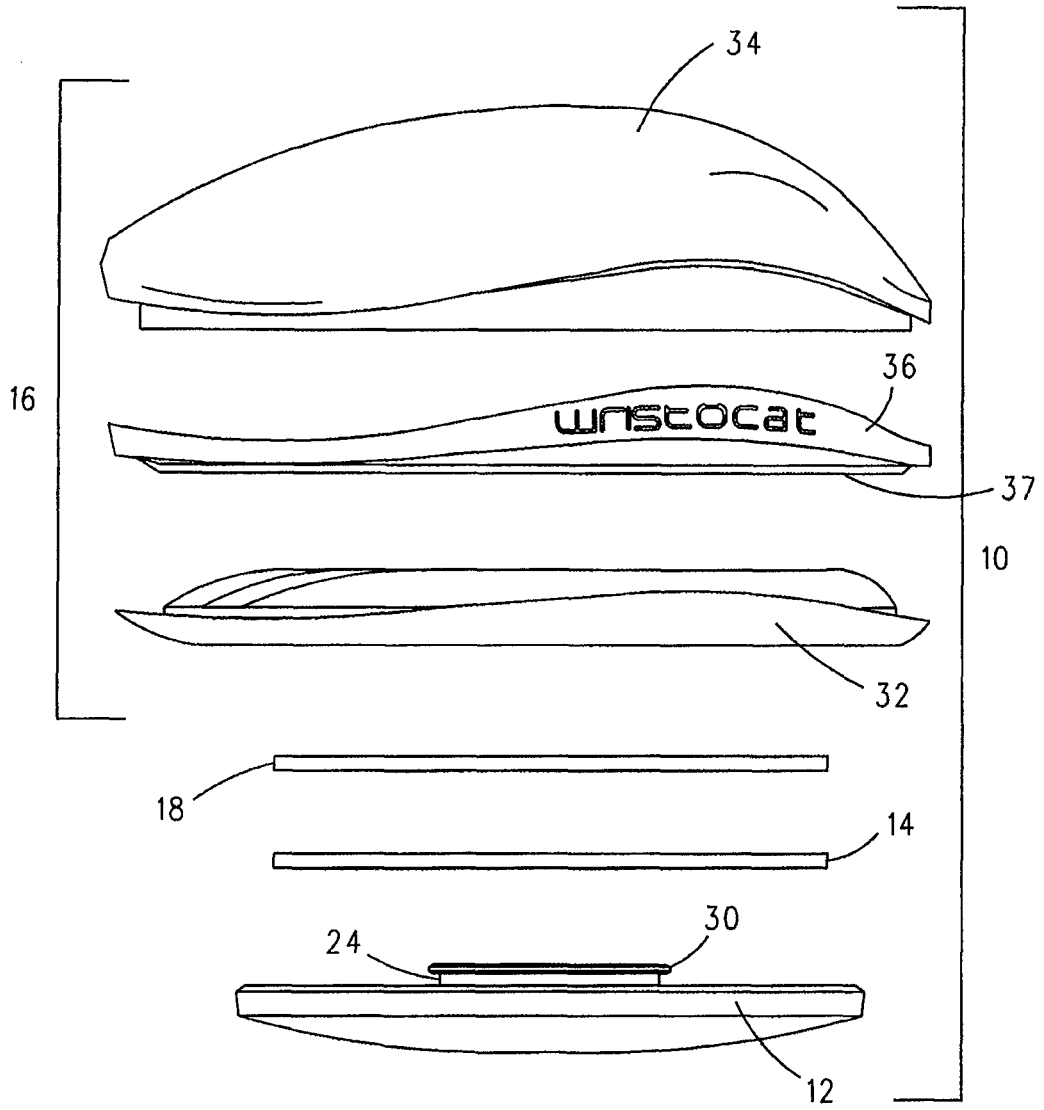
FIG. 2 is an exploded side view of the wrist support device of FIG. 1.
Figure 3:
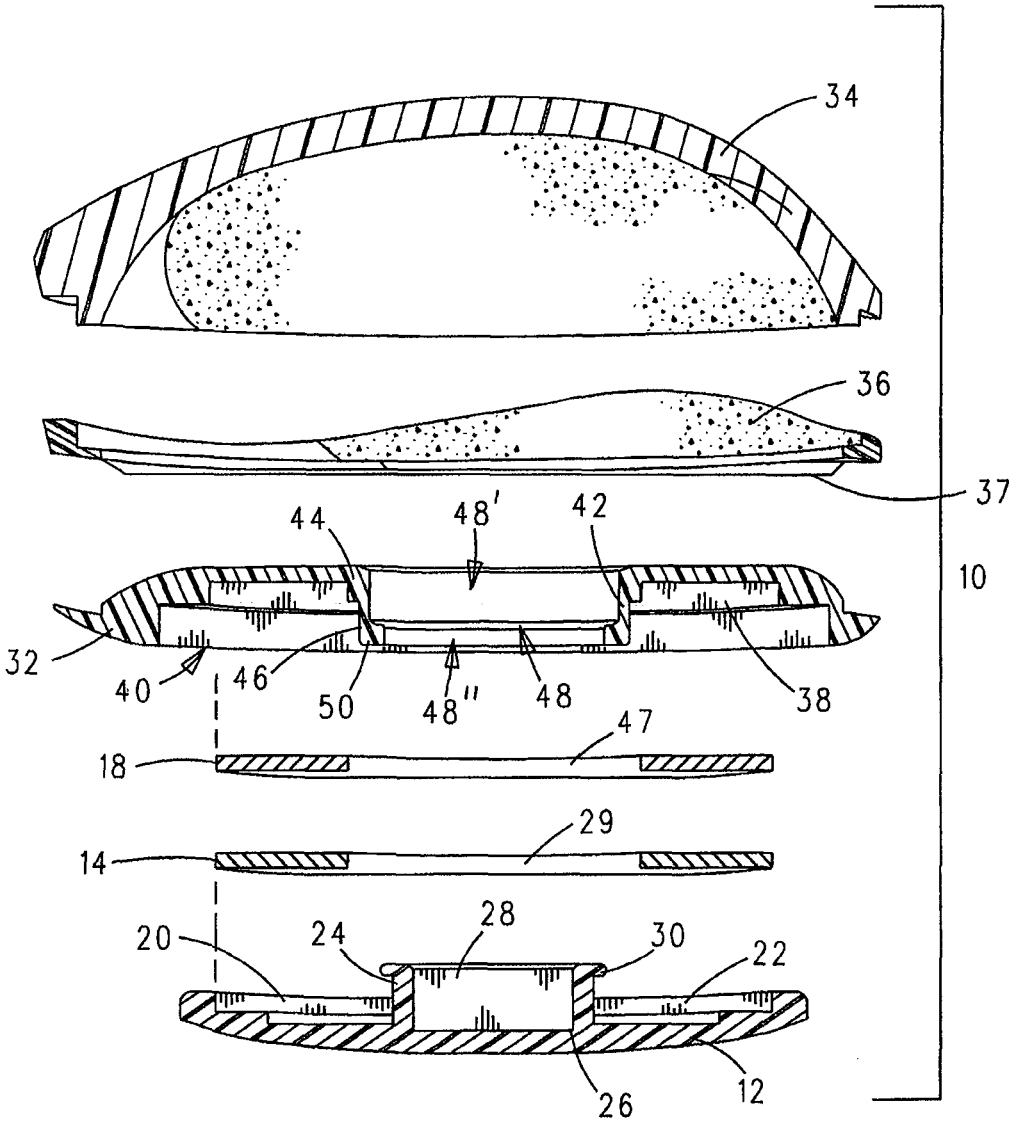
FIG. 3 is a perspective view of the wrist support device of FIG. 2.
Figure 4:
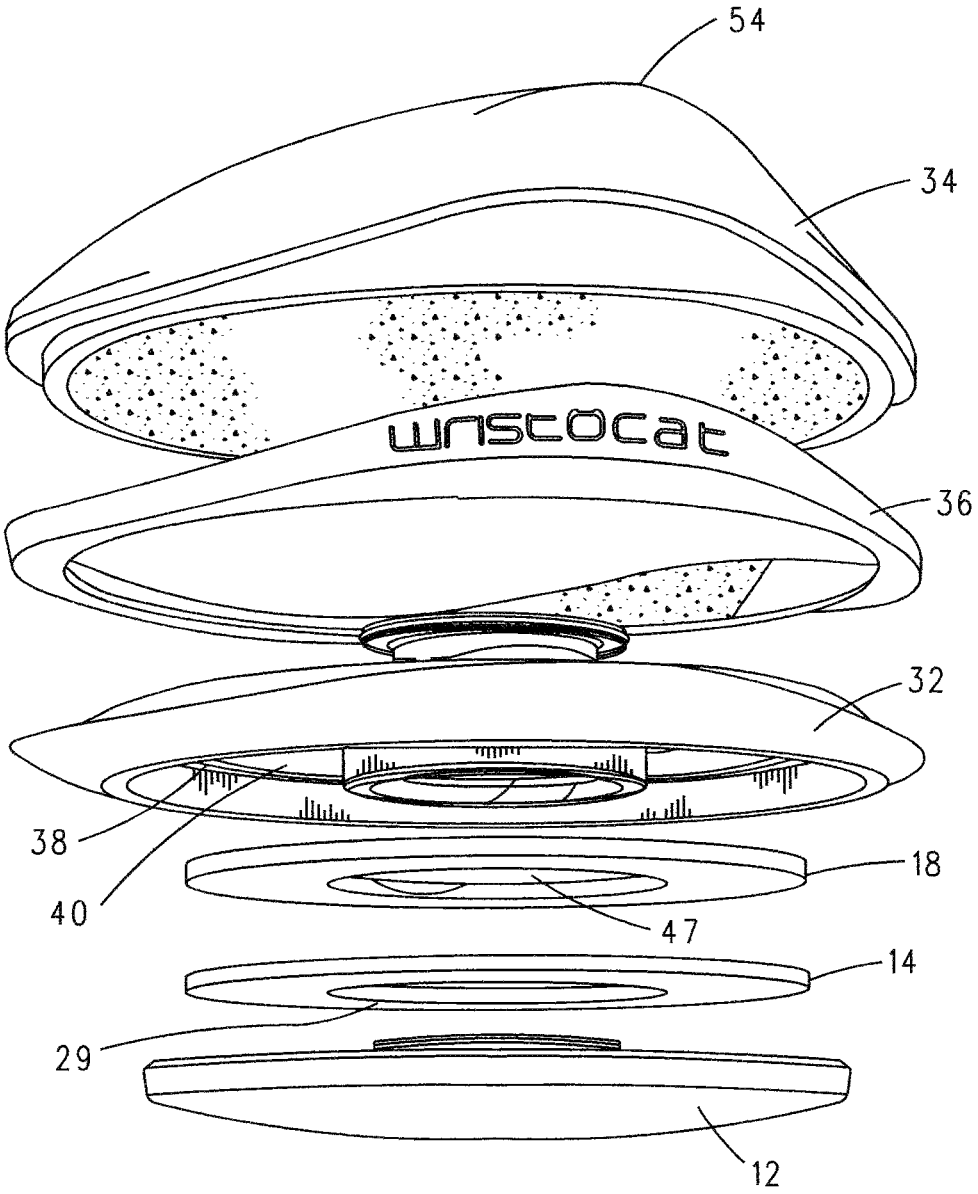
FIG. 4 is a cross-sectional view of the wrist support device of FIG. 2.

Various non-limiting examples will now be described with reference to the accompanying figures where like reference numbers correspond to like or functionally equivalent elements.

For purposes of the description hereinafter, the words "upper", "lower", "right", "left", "vertical", "horizontal", "top", "bottom", lateral", longitudinal", and like spatial terms relate to the described aspects as oriented in the drawing figures.

An example movable wrist support 10 includes magnetic levitation means to actively float and elevate the user's hand on a friction-free, magnetic barrier that enables unrestricted natural motion, gesture, and micro adjustment. The movable wrist support provides cushioning to absorb repetitive strain to the hand and carpal tunnel region of the wrist anytime the individual uses a computer input device. Further, the magnetic barrier serves to limit vibration transfer while an individual uses a computer input device. The example movable wrist support device alleviates injuries such as repetitive stress injury and carpal tunnel syndrome, associated with prolonged usage of such devices.

As shown in FIGS. 1-6, the movable wrist support 10 includes a base member 12 having a first magnet 14 and having a second magnet 18 provided in an assembled position. The first magnet 14 and the second magnet 18 are oriented in magnetic opposition to each other in a manner that levitates the levitating assembly 16 a distance above the base member 12 to provide support, cushioning, and independent movement of the levitating assembly 16 relative to the base member 12.

The base member 12 includes an annular seat 20 defined within a cavity 22 of the base member 12. The first magnet 14 can be ring shaped and configured to fit within the cavity 22 on the annular seat 20. The first magnet 14 can be snapped or molded directly to the annular seat 20.

A connection post 24 having a first end 26 and a second end 28, extends upwardly from a floor of the cavity 22 through a hole 29 defined in the first magnet 14. A flange 30 can be provided on the second end 28 of the connection post 24 for connecting and aligning the base member 12 to the levitating assembly 16 as is explained in further detail hereafter.

The bottom of base member 12 can be comprised of rigid, low friction material designed to slide easily along a work surface. In one embodiment the base member 12 can have a bottom surface with a flat central portion that arcs upwardly, away from the work surface, moving from the flat central portion towards the perimeter of the base member 12, to reduce contact surface between the base member 12 and the work surface, thereby reducing friction while providing a stable foundation. In another embodiment, ultra-low friction footing material can be provided to enable sliding and quiet operation.

The levitating assembly 16, sometimes referred to herein as "wrist support member", includes a magnetic chamber housing 32 and a removable and replaceable wrist support surface member 34. The magnetic chamber housing 32 and the wrist support surface member 34 can be manufactured as separate parts, or alternatively, can be formed as one integral part. When the magnetic chamber housing 32 and the wrist support surface member 34 are manufactured separately, the levitating assembly 16 can further include a connecting member 36 for connecting the magnetic chamber housing 32 and the wrist support surface member 34. Connecting member 36 can be separate element or can be an integral part of one or both of magnetic chamber housing 32 and wrist support surface member 34.

In an example, connecting member 36 can be formed of an elastic material that can be utilized to couple wrist support surface member 34 to magnetic chamber housing 32, for example, in the event of dimensional mismatches between the coupling surfaces thereof. However, this is not to be construed in a limiting sense since it is envisioned that wrist support surface member 34 can be coupled directly to magnetic chamber housing 32 as shown, for example, in FIG. 5.

In another example, connecting member 36 can, also or alternatively, be formed of or can include as a part thereof magnetically susceptible material 37 (FIGS. 2 and 3) that can be attracted to first magnetic 14 and/or second magnetic 18 when connecting member 36 is positioned between wrist support surface member 34 and magnetic chamber housing 32. The illustration of magnetically susceptible material 37 on the bottom of connecting member 36 (FIGS. 2 and 3) is not to be construed in a limiting sense since it is envisioned that connecting member 36 can also or alternatively be made of magnetically susceptible material 37.

In an example, magnetically susceptible material 37 can be in the form of a sheet or a number of individual pieces that can be coupled to connecting member 36 in some manner, e.g., adhesive or friction fit, whereupon when wrist support surface member 34 and connecting member 36 are assembled to the top of magnetic chamber housing 32, first magnetic 14 and/or second magnetic 18 magnetically attract magnetically susceptible material 37 and, hence, wrist support surface member 34 toward magnetic chamber housing 32.

The use of connecting member 36 formed of or including magnetically susceptible material 37 enables quick removal and replacement of wrist support surface member 34. For example, wrist support surface member 34 having the dome shape (FIG. 2) can be replaced with wrist support surface member 52 (FIG. 6) having a saddle shape. In this regard, connecting member 36 formed of or including magnetically susceptible material 37 can be configured to interface between magnetic chamber housing 32 and a wrist support surface member having any suitable and/or desirable shape for supporting the wrist of a user.

The chamber housing 32 includes an annular seat 38 defined within a recess 40 of the magnetic chamber housing 32. The second magnet 18 can be ring shaped and configured to fit within the annular seat 38 of the recess 40. The second magnet 18 can be snapped or molded directly to the annular seat 38.

The magnetic chamber housing 32 can be shaped to prevent unwanted metal and debris from being pulled into the annular seat 38. A guide column or opening 42 having a first end 44 and a second end 46 extends downwardly from a surface of the recess 40 and through an interior hole 47 defined in the second magnet 18. The guide column 42 defines a hollow cavity 48 for receiving the flange 30 of the connection post 24. The hollow cavity 48 can take any shape. In an example, the hollow cavity 48 corresponds in shape to receive and permit limited vertical and lateral movement of the flange 30 in the cavity 48. More specifically, the hollow cavity 48 can be slightly wider than the flange 30 to allow limited tilting, articulation and/orbiting of the flange 30.

The second end 46 of the guide column 42 can be angled inwardly, towards the hollow cavity 48 to form a lip shaped stop member 50 that narrows the interior of the cavity 48 and forms a narrower opening at the second end 46. The connection post 24 and the guide column 42 form a means for connecting and aligning the flange 30 within the hollow cavity 48 that prevents the levitating assembly 16 from being disconnected from the base member 12 and aligns the levitating assembly 16 directly above the base member 12.

Figure 5:
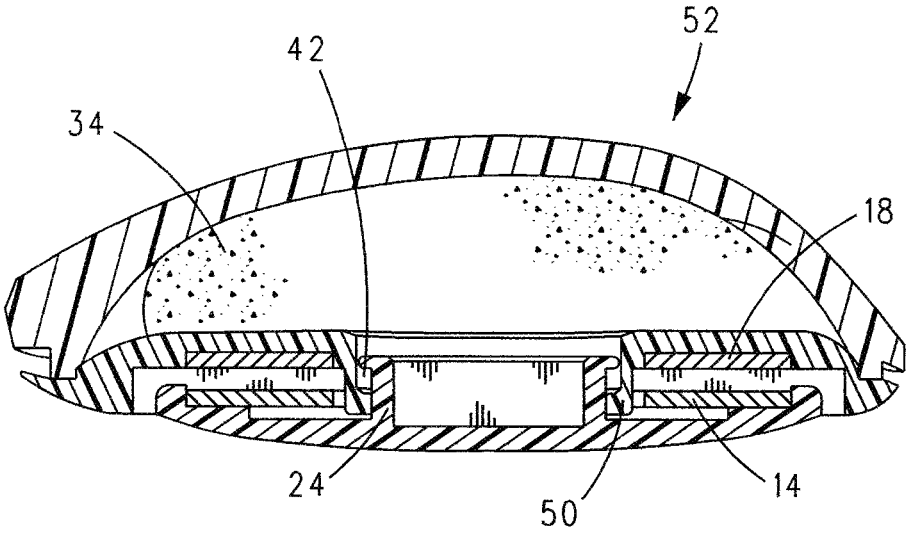
FIG. 5 is a cross-sectional view of the wrist support device of FIG. 1.

For example, with reference to FIG. 5, when the levitating assembly 16 is levitating above the base member 12 and the flange 30 is located within the hollow cavity 48, the flange 30 contacts an inner wall of the guide column 42 while an inner edge of the stop member 50 contacts an outer wall of the connection post 24 to stabilize and align the levitating assembly 16. As the user moves the wrist support surface member 34 vertically with respect to the base member 12, the entirety of flange 30 can move vertically within the upper part 48' of hollow cavity 48 and the outer wall of connection post 24 can move vertically within the lower part 48" of hollow cavity 48 defined by the inside of stop member 50. The connection means can restrict movement of the levitating assembly 16 in both a vertical and lateral direction relative to the base member 12. Nevertheless, the connection means can allows the levitating assembly 16 to swivel, tilt and rock within the limits of the physical constraints.

Other connection means, such as the straps disclosed in U.S. Provisional Patent No. 62/145,819, so long that the levitation assembly 16 remains elevated and centrally aligned above the base member 12.

The wrist support surface member 34 includes a top surface 52 upon which a user rests his or her wrist. As used herein, wrist includes the wrist and/or hand of a user. In an example the wrist support surface 52 can include a hollow, flexible, inverted dome area. In an example, shown in FIG. 6, the wrist support surface 52 can be saddle shaped and include three raised elements 54A, 54B, 56C, referred to in combination as 54. This saddle shape can be designed to comfortably accommodate the hand of user. The wrist support surface member 34 can be constructed from a soft pliable material and can be attached to the magnetic chamber housing 32 directly or via connecting member 36, with or without magnetically susceptible material 37 forming or being included on connecting member 36. As discussed above, the wrist support surface member 34 can be removably detachable from the magnetic chamber housing 32, either directly or via connecting number 36, to allow for interchangeable wrist support surface members, e.g., 34 or 52.

In a different example, wrist support surface members can include different saddle or top surface 52 options exhibiting various properties. For example, one wrist support surface member 34 can comprise a thermal regulator to heat or cool the wrist area while another wrist support surface member 34 can include a built in massage stimulator for therapeutic relief, as is disclosed in U.S. Provisional Patent No. 62/145,819.

Figure 6:
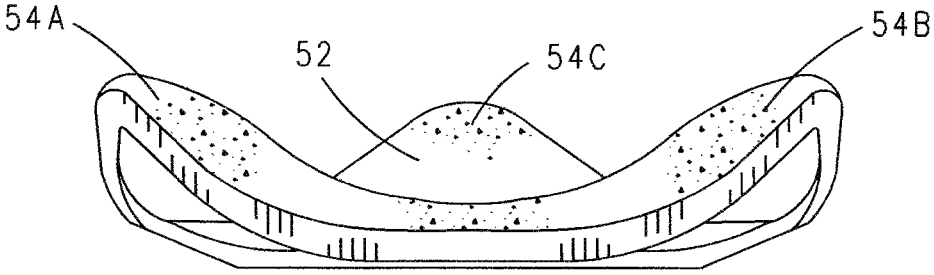
FIG. 6 is a rear view of the wrist support device of FIG. 1.

In the example of FIG. 6, the three raised structural elements 54 extend upwardly from the wrist support surface member 34 and can cradle the wrist of a user when the wrist is resting on the device. The raised elements 54 also provide rigidity to the wrist support surface member 34. In an example, the raised elements 54 are positioned such that the distance in between can form a Y shaped, pliable and flexible channel that corresponds to the contour features common to the human wrist and palm. The recessed, hollow dome can provide a soft, flexible alternative to gels and pads, while working with magnetic levitation to further accommodate and support subtle movements while molding to the shape of the user's wrist. Raised elements 54A, 54B, located at the rear of the saddle can hug the wrist of a user when the wrist is resting on the device while raised element 54C in the front center of the device is positioned lower than the rear elements and can corresponds to the depressed area of the human palm.

The hollow area below the dome can be designed to flex and conform to a hand resting on the device, while the structural elements 54 can be more rigid, to reinforce the structure, cradle the wrist, and provide additional spring, cushioning and support.

Magnetic levitation means can include the first magnet 14 and the second magnet 18. The first 14 and the second magnet 18 can be opposing or repelling magnets (or poly magnets) positioned and secured in a vertical alignment within the wrist support device 10 as previously described. In this configuration, a magnetic force can be generated by the opposing magnetic poles, resulting in a force that can be sufficient to lift and levitate the levitating assembly 16 a distance above the base member 12 when a wrist is positioned on a surface of the wrist support surface member 34. The magnetic means provides an opposing magnetic force that generates a springing effect to elevate the hand/or wrist, absorb shock, and enable free orbiting and movement.

In an example operation, the wrist support 10 is positioned behind any computer input device, including but not limited to a mouse, touchpad, trackball or keyboard. A user rests his or her wrist on the saddle shaped wrist support surface 52 and interacts with the input device in a normal manner. The wrist support 10 can conform to the user's wrist and hand, and can comfortably cradle the palm within the hollow, dome shaped cavity below the elevated wrist and position the user's wrist in a neutral position thereby minimizing stress. The saddle shaped wrist support surface 52 can distribute the weight of the hand, can eliminate contact between the wrist and the work surface, and can provide ergonomic support for a user's hand by providing active alignment and elevation when a user's wrist is resting on the wrist support surface 52.

The magnetic levitation means can provide an operational connection, levitating the levitation assembly 16 above the base member 12, while removing contact and friction between those surfaces, to minimize the transfer of vibration between those surfaces.

Figure 7:
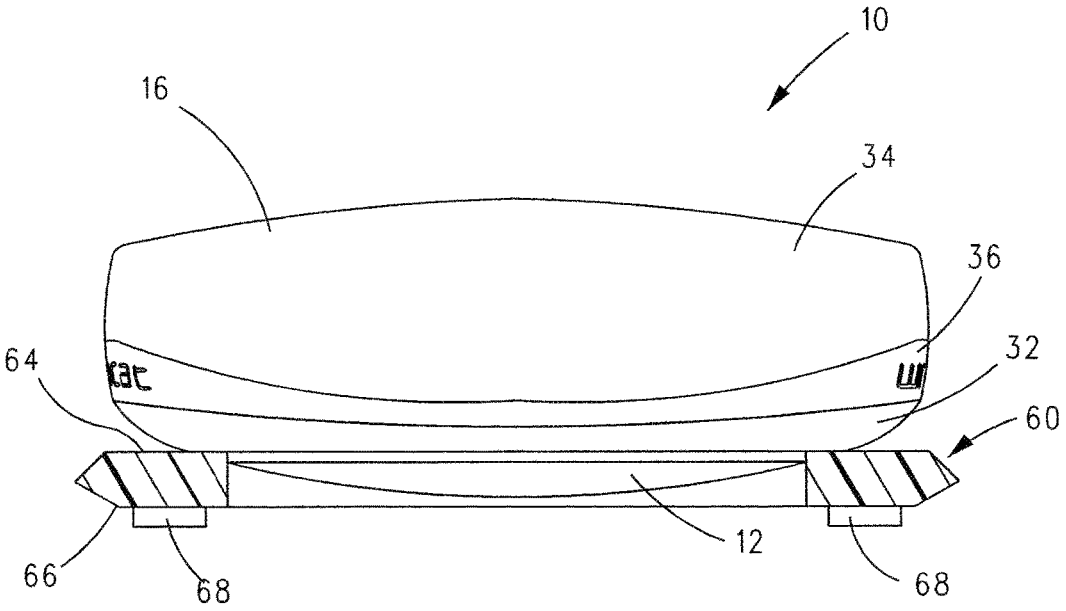
FIG. 7 is a side view of the wrist support device of FIG. 1 positioned on top of an example slider assembly that includes pads, desirably low friction pads, positioned on a side of the slider assembly opposite the wrist support device.
Figure 8:
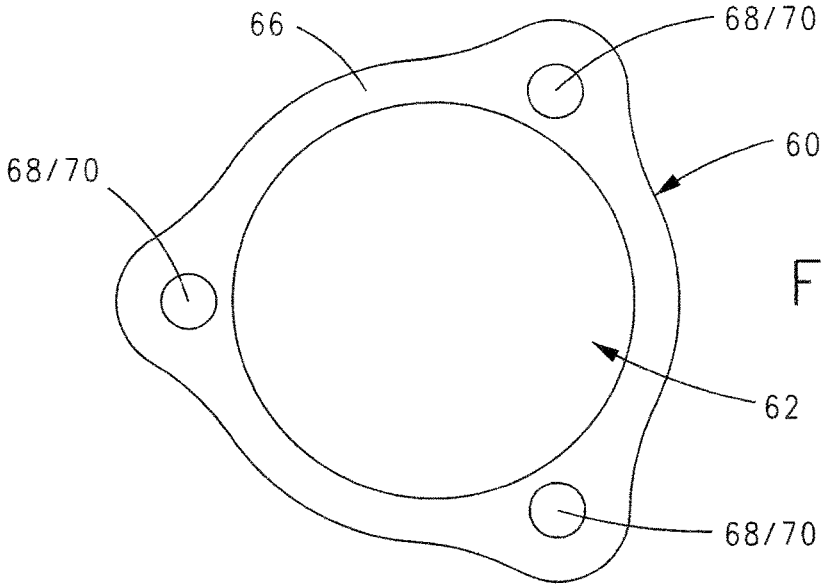
FIG. 8 is a plan view of the bottom of the example slider assembly shown in FIG. 7.

With reference to FIGS. 7 and 8, wrist support 10 can include an optional slider assembly 60 upon which a one side, e.g., the bottom, of wrist support 10 can rest. In an example, slider assembly 60 can have an opening 62 configured to receive the bottom of base member 12 of movable wrist support 10. Slider assembly 60 includes a top surface 64. In an example, at least a part of top surface 64 surrounding opening 62 can be configured to be positioned proximate to or in contact with a bottom of magnetic chamber housing 32 surrounding base member 12. However, this is not to be construed in a limiting sense since it is envisioned that opening 62 and base member 12 can have complementary shapes, whereupon base member 12 received in opening 62 supports magnetic chamber housing 32 in spaced relation to top surface 64.

Slider assembly 60 also includes a bottom surface 66. In the example shown in FIG. 8, slider assembly 60 has a rounded-triangular shape. However, this is not to be construed in a limiting sense since any suitable and/or desirable shape of slider assembly 60 configured to support movable wrist support 10 can be utilized.

In the example shown in FIG. 7, each corner of slider assembly 16 can include a pad 68 made of a rigid, low friction material designed to slide easily along a work surface.

Optional slider assembly 60 can enhance the stability of movable wrist support 10 during use and movement on a work surface.

Figure 9:
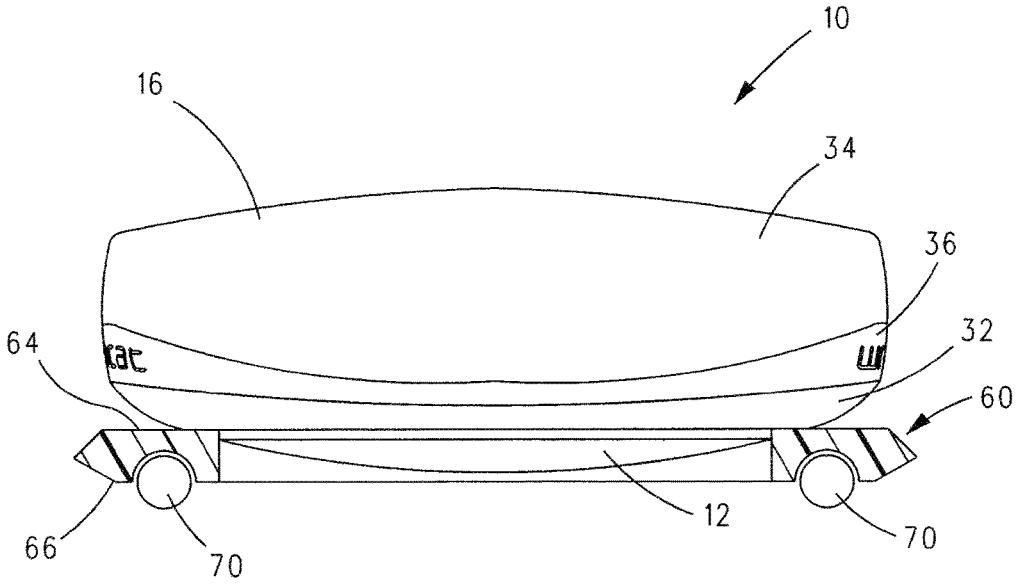
FIG. 9 is a side view of the wrist support device of FIG. 1 positioned on another example slider assembly that includes rollers in place of the pads.

With reference to FIG. 9 and with continuing reference to FIGS. 7 and 8, in another example, pads 68 can be replaced with rollers 70 to provide an optional, low-friction means to move slider assembly 60 and movable wrist support 10 on a work surface.

The illustration herein of slider assembly having the shape shown in FIG. 8 and including three pads 68 and/or three rollers 70 is not to be construed in a limiting sense since it is envisioned that slider assembly can have any suitable and/or desirable shape and any suitable and/or desirable number of pads 68 and/or rollers 70.

Slider assembly 60 can also be configured to match the magnetic chamber housing 32 and allow the movable wrist support 10 to be used in an inverted manner, where base member 12 is fitted with a support pad (like wrist support member 34) and magnetic chamber housing 32 rests on slider assembly 60 and is connected magnetically via connecting member 36 formed of or including magnetically susceptible material.

As can be seen, disclosed herein is a movable wrist support device for elevating and enabling natural motion of the hand/or wrist of an individual when the individual is using a computer input device. The movable wrist support device comprises a base member; a wrist support member; means for magnetically levitating the wrist support member a distance above the base member when the wrist support member is positioned above the base member; and a connecting member between the base member and the wrist support member, wherein the connecting member includes magnetically susceptible material that is magnetically attracted to the means for magnetically levitating the wrist support member.

The magnetically susceptible material can be a separate element or an integral part of the connecting member.

The movable wrist support device can further include a slide assembly upon which the wrist support device rests. In an example, the slide assembly can be coupled to the wrist support device, for example, the slide assembly can be coupled to the base member.

The slide assembly can include, on a side of the slide assembly opposite the base member, at least one of pads or rollers configured to contact a work surface during use of the movable wrist support device. The pad can be made from a low friction material designed to slide easily along a work surface.

The means for magnetically levitating the wrist support member can include a first magnet that is in magnetic opposition to a second magnet.

The first magnet can be housed within the base member and the second magnet can be housed within the wrist support member.

The movable wrist support device can further include means for preventing the wrist support member from moving a distance apart from the base member and laterally aligning the wrist support member with respect to the base member.

The exterior surface of the wrist support member can be dome shaped or saddle shaped.

The base member can have a first tube and the wrist support member can have a second tube. When the wrist support member is levitating above the base member, one of the first and second tubes can be positioned at least partially inside the other one of the first and second tubes for aligning the wrist support member with respect to the base member.

The first tube can include a first flange and the second tube can include a second flange. The first flange can be adapted to contact the second flange to limit separation of the base member and the wrist support member.

Also disclosed herein is a movable wrist support device for elevating and enabling natural motion of the hand/or wrist of an individual when the individual is using a computer input device. The movable wrist support device comprises a base member; a wrist support member; means for magnetically levitating the wrist support member a distance above the base member when the wrist support member is positioned above the base member; and a slide assembly upon which the wrist support device rests.

In an example, the slide assembly can be coupled to the wrist support device, for example, the slide assembly can be coupled to the base member.

The slide assembly can include, on a side of the slide assembly opposite the base member, at least one of a pad or a roller configured to contact a work surface during use of the movable wrist support device. The pad is can be made from a low friction material designed to slide easily along a work surface.

The wrist support member can include magnetically susceptible material that is magnetically attracted to the means for magnetically levitating the wrist support member.

The magnetically susceptible material can be a separate element or an integral part of the wrist support member.

The means for magnetically levitating the wrist support member can includes a first magnet that is in magnetic opposition to a second magnet.

The first magnet can be housed within the base member and the second magnet can be housed within the wrist support member.

The movable wrist support device can further comprise means for preventing the wrist support member from moving a distance apart from the base member and laterally aligning the wrist support member with respect to the base member.

The wrist support member can be dome shaped or saddle shaped.

The base member can have a first tube and the wrist support member can have a second tube. When the wrist support member is levitating above the base member one of the first and second tubes can be positioned at least partially inside the other one of the first and second tubes for aligning the wrist support member with respect to the base member.

The first tube can include a first flange and the second tube can include a second flange. The first flange can be adapted to contact the second flange to limit separation of the base member and the wrist support surface member.

The examples have been described with reference to the accompanying figures. Those skilled in the art can make modifications and alterations without departing from the scope and spirit. Accordingly, the above examples are intended to be illustrative rather than restrictive.

The invention claimed is:

1. A movable wrist support device for elevating and enabling natural motion of the hand or wrist of an individual when the individual is using a computer input device, the movable wrist support device comprising:

a base member;

a wrist support surface member;

means for magnetically levitating the wrist support surface member a distance above the base member when the wrist support surface member is positioned above the base member; and a connecting member between the base member and the wrist support surface member, wherein the connecting member includes magnetically susceptible material that is magnetically attracted to the means for magnetically levitating the wrist support member, wherein the connecting member is positioned between the means for magnetically levitating and the wrist support surface member.

2. The movable wrist support device of claim 1, wherein the magnetically susceptible material can be a separate element or an integral part of the connecting member.

3. The movable wrist support device of claim 1, further including a slide assembly upon which the wrist support device rests.

4. The movable wrist support device of claim 3, wherein the slide assembly includes, on a side of the slide assembly opposite the base member, at least one of pads or rollers configured to contact a work surface during use of the movable wrist support device.

5. The movable wrist support device of claim 1, wherein the means for magnetically levitating the wrist support member comprises a first magnet that is in magnetic opposition to a second magnet.

6. The movable wrist support device of claim 5, wherein:

the first magnet is housed within the base member; and the second magnet is housed within a wrist support member that supports the wrist support surface member.

7. The movable wrist support device of claim 1, further comprising means for preventing the wrist support surface member from moving a distance apart from the base member and laterally aligning the wrist support surface member with respect to the base member.

8. The movable wrist support device of claim 1, wherein the wrist support surface member is dome shaped or saddle shaped.

9. The moveable wrist support device of claim 1, wherein:

the base member has a first tube;

a wrist support member that supports the wrist support surface member has a second tube; and when the wrist support surface member is levitating above the base member one of the first and second tubes is positioned at least partially inside the other one of the first and second tubes for aligning the wrist support member with respect to the base member.

10. The moveable wrist support device of claim 9, wherein the first tube comprises a first flange and the second tube comprises a second flange, the first flange adapted to contact the second flange to limit separation of the base member and the wrist support member.

11. A movable wrist support device for elevating and enabling natural motion of the hand/or wrist of an individual when the individual is using a computer input device, the movable wrist support device comprising:

a base member;

a wrist support member;

means for magnetically levitating the wrist support member a distance above the base member when the wrist support member is positioned above the base member; and a slide assembly upon which the wrist support device rests.

12. The movable wrist support device of claim 11, wherein the slide assembly includes, on a side of the slide assembly opposite the base member, at least one of a pad or a roller configured to contact a work surface during use of the movable wrist support device.

13. The movable wrist support device of claim 11, wherein the wrist support member includes magnetically susceptible material that is magnetically attracted to the means for magnetically levitating the wrist support member.

14. The movable wrist support device of claim 13, wherein the magnetically susceptible material comprises a connecting member of the wrist support member.

15. The movable wrist support device of claim 11, wherein the means for magnetically levitating the wrist support member comprises a first magnet that is in magnetic opposition to a second magnet.

16. The movable wrist support device of claim 15, wherein:

the first magnet is housed within the base member; and the second magnet is housed within the wrist support member.

17. The movable wrist support device of claim 11, further comprising means for preventing the wrist support member from moving a distance apart from the base member and laterally aligning the wrist support member with respect to the base member.

18. The movable wrist support device of claim 11, wherein the wrist support member is dome shaped or saddle shaped.

19. The moveable wrist support device of claim 1, wherein:

the base member has a first tube;

the wrist support member has a second tube; and when the wrist support member is levitating above the base member one of the first and second tubes is positioned at least partially inside the other one of the first and second tubes for aligning the wrist support member with respect to the base member.

20. The moveable wrist support device of claim 9, wherein the first tube comprises a first flange and the second tube comprises a second flange, the first flange adapted to contact the second flange to limit separation of the base member and the wrist support member.

* * * * *